US006891454B1

(12) United States Patent
Naito et al.

(10) Patent No.: US 6,891,454 B1
(45) Date of Patent: May 10, 2005

(54) SWITCH

(75) Inventors: Yasuyuki Naito, Tokyo (JP); Yoshito Nakanishi, Tokyo (JP); Norisato Shimizu, Kanagawa (JP); Kunihiko Nakamura, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/625,154

(22) Filed: Jul. 23, 2003

(30) Foreign Application Priority Data

Jul. 26, 2002 (JP) ..... 2002-217871
Jul. 7, 2003 (JP) ..... 2003-192682

(51) Int. Cl.[7] ..... H01H 51/22
(52) U.S. Cl. ..... 335/78; 200/181
(58) Field of Search ..... 335/78; 200/181

(56) References Cited

U.S. PATENT DOCUMENTS 6,072,686 A * 6/2000 Yarbrough ..... 361/234
6,218,911 B1 * 4/2001 Kong et al. ..... 333/101
6,310,526 B1 * 10/2001 Yip et al. ..... 333/262
6,440,767 B1 * 8/2002 Loo et al. ..... 438/52
6,504,118 B2 * 1/2003 Hyman et al. ..... 200/181
6,720,851 B2 * 4/2004 Hallbjorner et al. ..... 335/78
2003/0227361 A1 * 12/2003 Dickens et al. ..... 335/78

FOREIGN PATENT DOCUMENTS

JP 2007014 1/1990

OTHER PUBLICATIONS

Jeremy B. Muldavin & Gabriel M. Rebeiz, "Inline Capacitive and DC–Contact MEMS Shunt Switches" IEEE Microwave and Wireless Components Letters, vol. 11, No. 8, Aug. 2001, pp. 334–336.

* cited by examiner

*Primary Examiner*—Lincoln Donovan
*Assistant Examiner*—Bernard Rojas
(74) *Attorney, Agent, or Firm*—RatnerPrestia

(57) ABSTRACT

A switch for switching over a propagation path of external signal by contacting or non-contacting a movable member to or from an electrode. The switch comprises an input port for inputting an external signal, a movable member connected to the input port, a first electrode for propagating the external signal, a first control power supply connected to the first electrode and for generating a control signal, a second electrode for blocking the external signal, and a second control power supply connected to the second electrode and for generating a control signal. The first control power supply provides a control signal to the first electrode. The movable member is displaced by a driving force generated based on a potential difference between the movable member and first electrode and a potential difference between the movable member and second electrode, thereby being contacted to the first or second electrode.

11 Claims, 15 Drawing Sheets

SWITCH

FIELD OF THE INVENTION

This invention relates to a switch, for use on an electronic circuit or the like, adapted for switching over a propagation path for an external signal by contacting or non-contacting the movable member to or from the electrode.

BACKGROUND OF THE INVENTION

The conventional RF-MEMS switch is a mechanical switch having movable members in a membrane or rod form supported at both ends or in a cantilever, so that by placing them into or out of contact with the electrodes, signal propagation path can be switched over. Although the power sources for driving the membrane or movable member, in many cases, use those based on electrostatic force, there are released ones using magnetic force.

As a micro-fabricated switch in a size around 100 $\mu$m, there is known one described in IEEE Microwave and Wireless Components letters, Vol. 11, No 8, August 2001 p334. This switch forms a signal line for radio-signal transmission over a membrane, to provide a control electrode immediately beneath the signal line. In case a direct current potential is applied to the control electrode, the membrane is pulled and deformed toward the control electrode by an electrostatic force. By a contact with a ground electrode formed on the substrate, the signal line formed on the membrane becomes a shorted state. Due to this, the signal flowing through the signal line is attenuated down or blocked off.

Unless a direct current potential is applied to the control electrode, there is no deformation in the membrane. The signal flowing through the signal line on the membrane is allowed to pass through the switch without encountering the loss through the ground electrode.

Meanwhile, as a conventional method for controlling the positioning of the movable member, there is known an art shown in JP-A-2-7014. This structure is arranged to open and close an optical path by a micro-switch, thereby turning the signal on/off. When to pass light, a voltage is applied to between a vibration plate and a flat plate, to lift the element through an electrostatic force. When to block light, voltage is rendered zero to cancel the electrostatic force whereby it is returned to the former position by a spring force of the vibration plate. Due to this, the element blocks the light.

At this time, in case the voltage is abruptly applied or reduced to zero, a phenomenon called chattering takes place, resulting in vibration of the element. It takes a time in reaching a stability. Consequently, it is a practice to apply a voltage called a preparatory voltage pulse before applying a control voltage, thereby preventing chattering. The condition for stabilization is determined by a preparatory pulse voltage V1 and a pulse width $\tau$1, and a spacing $\tau$2 between the preparatory pulse voltage V2 and the major control voltage. In case V1=V2 and $\tau$1=$\tau$2 is assumed, then $\tau$1 has a boundary condition of one-sixth of the eigenfrequency.

The research and development of RF-MEMS switch in the IEEE Microwave and Wireless Components letters originates aiming at those for the military and aerospace applications, wherein the research and development is focused on by what means signal propagation characteristic is to be improved. However, in the case of the home-use application including personal digital assistants, there is a desire for an RF-MEMS switch meeting simultaneously various conditions of durability, high-speed response, low consumption power, low driving voltage, size reduction and the like, besides improved signal propagation characteristic as a natural matter.

However, the direct current voltage of as high as approximately 30 V or more is required to contact the membrane toward the control electrode. It is not preferred to build such a switch as needing a high voltage within a radio transceiver apparatus.

Meanwhile, in order to achieve high electrical isolation on a switch, it is required to provide a comparatively wide gap between a movable member and an electrode. In such a case, it is critical by what means the movable member is to be driven with a great displacement and high speed on a low drive voltage.

Also, on the RF-MEMS switch for example, when the movable member is contacted on the electrode, in case the drive voltage is turned off into a state not to give an electrostatic force to the movable member, the movable member is returned by its own spring force to a predetermined position distant from the electrode. For contacting the movable member at high speed to the electrode by a low drive voltage, the spring force of the movable member must be weakened. This, however, poses a problem of low response speed for the movable member to return to a predetermined position.

Also, on a mechanical switch, in returning the movable member contacted with the electrode to a position where isolation is high not to cause a capacitance coupling of movable member and electrode, there is a problem of overshoot, i.e. the movable member is to displace beyond the predetermined position. Where the overshoot of movable member is great, capacitance coupling possibly takes place on the electrode and movable member, as a signal propagation path, resulting in forming an incorrect signal path.

On the other hand, the switch of JP-A-2-7014 requires a sufficient connection area in order to secure a capacitance during switch-on. In the case the beam assumably has a width of several $\mu$m, the beam has a length on the order of several hundred $\mu$m. Accordingly, it is difficult to fix a beam having a length of several hundred $\mu$m only at one end. Higher stability is available rather by a both-ends-supported beam fixed at both ends.

However, where fixed at both ends, the substrate and beam materials, if different, cause a change of internal stress due to a difference in the thermal expansion coefficient between the materials, thereby changing the spring constant. The eigenfrequency of a structural body is determined by a mass and spring constant of the beam, as shown in Equation 1. Accordingly, temperature change causes eigenfrequency change correspondingly.

$$f=l/\pi\sqrt{k/m} \qquad \text{Eq.1}$$

Even in case a preparatory pulse voltage is applied to avoid chattering, a switch temperature change causes a change of eigenfrequency, hence changing the optimal preparatory pulse voltage. For example, when the preparatory pulse voltage is optimized at room temperature, a rise in switch temperature causes an eigenfrequency increase. Based on a preparatory pulse voltage same as that at room temperature, it is impossible to prevent chattering.

From these problems and requests, there is a desire for a switch realized with switch high-speed response on low driving voltage and a widened gap at between the movable member and the electrode, enabling to increase the response speed for the movable member contacted on the electrode to return to a predetermined position distant from the electrode and to control the magnitude of an overshoot of the movable member.

SUMMARY OF THE INVENTION

It is an object of the present invention to provide a high-performance switch realized with signal propagation characteristic improvement, high speed response, low consumption power and low driving voltage, and an electronic appliance using the same.

A switch of the present invention is a switch for switching over an external signal propagation path by contacting or non-contacting a movable member to or from an electrode, the switch comprising: an input port for inputting an external signal; and a movable member connected to the input port; a first electrode for propagating the external signal; a first control power supply connected to the first electrode and for generating a control signal; a second electrode for blocking the external signal; and a second control power supply connected to the second electrode and for generating a control signal; whereby the first control power supply provides a control signal to the first electrode, the movable member being displaced by a driving force generated based on a potential difference between the movable member and first electrode and a potential difference between the movable member and second electrode, thereby being contacted to the first or second electrode. This makes it possible to realize a switch for signal propagation characteristic improvement, high-speed response, low consumption power and low driving voltage.

DESCRIPTION OF THE EXEMPLARY EMBODIMENT

Exemplary embodiments of the present invention are demonstrated hereinafter with reference to the accompanying drawings.

1. First Exemplary Embodiment

Figure 1:
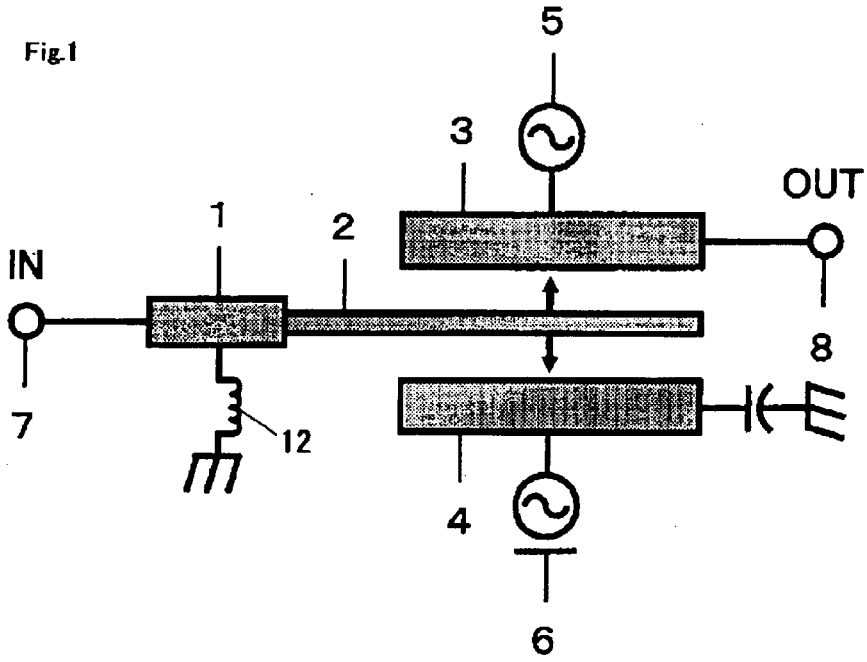
FIG. 1 is a plan view showing a schematic structure of a switch according to embodiment 1 of the present invention.

FIG. 1 depicts a plan view of a switch 1 in embodiment 1 of the present invention. An on-side electrode 3 is attached with an on-side control power supply 5 while an off-side electrode 4 is with an OFF-side control power supply 6. When the switch is on, a movable member 2 is to be contacted on the on-side electrode 3. The signal inputted through an input port 7 propagates to an output port 8 through the movable member 2 and on-side electrode 3. When the switch is off, the movable member 2 is to be contacted on the off-side electrode 4. The signal inputted through the input port 7 propagates to the ground through the movable member 2 and off-side electrode 4.

Figure 2:
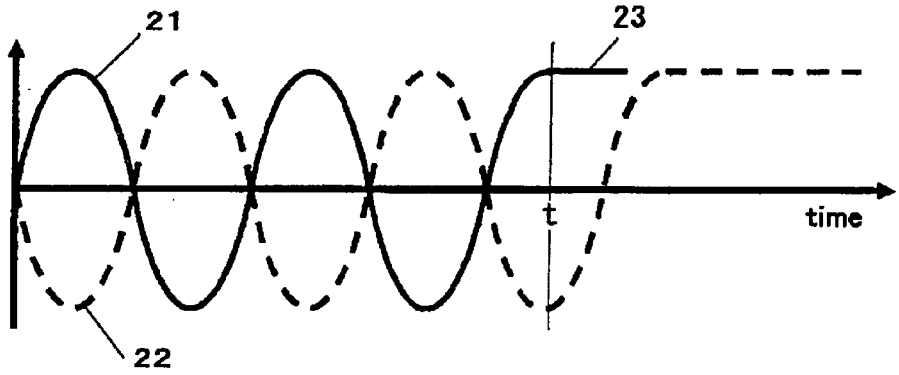
FIG. 2 is a characteristic figure showing a control signal and movable member position of the switch in embodiment 1 of the invention.

FIG. 2 shows a relationship between a control signal and a position of the movable member 2 in embodiment 1. FIG. 2 shows a control signal to be supplied to the on-side electrode 3 on one side. The on-side electrode 3 and off-side electrode 4 are provided with control signals 21 oppositely in phase alternately having 0 V at one end. The movable member 2 is grounded through an inductor 12, in a direct-current fashion. By an electrostatic force caused by a difference between the potentials alternately supplied to the movable member and the on-side electrode 3 and off-side electrode 4, the movable member 2 alternately displaces in directions toward the on-side electrode 3 and the off-side electrode 4, thus being vibrated as shown by a curve 22. The vibration is caused based on a control signal of alternating current voltage at a self-resonant frequency of the movable member 2. The movable member 2 is designed and fabricated to cause a vibration having a great displacement on a self-resonant mode in directions toward the on-side electrode 3 and off-side electrode 4. By vibration at the self-resonant frequency, the mechanism can cause a vibration having a great displacement on a low voltage.

In a drive scheme, a control signal 21 of alternating current voltage as shown in FIG. 2 is switched over, at time t, to a direct current voltage control signal 23 at a constant voltage, to apply an electrostatic force in a direction toward the on-side electrode 3 or off-side electrode 4 acting to contact the movable member 2. By thus placing the control signal 21 under control, to the movable member 2 is applied a constant external force in a direction toward the on-side electrode 3 or off-side electrode 4. By contacting the movable member 2 on the on-side electrode 3 or off-side electrode 4, the propagation path of signal is switched over.

Incidentally, even in a mode other than the self-resonant mode of the movable member 2, in the case a vibration speed and low drive voltage is obtainable to satisfy a sufficient vibratory displacement and desired response speed for switching during vibration of the movable member 2, vibration and switching is feasible at a frequency other than the self-resonant frequency of the movable member 2.

Meanwhile, besides the alternating current voltage control signal, it is possible to use a control signal in another waveform such as a rectangular waveform.

Also, although embodiment 1 showed the vibration driving scheme to the movable member by an electrostatic force, it is possible to realize a switch on a vibration driving scheme using another kind of driving force such as magnetic force.

According to the embodiment 1, the movable member 2 can be driven with a great displacement at high speed on a low drive voltage, making it possible to provide a comparatively broad gap at between the movable member 2 and the electrode 3, 4. This enables high electrical isolation on the switch, to realize a high-performance switch having a high signal on/off ratio.

Meanwhile, by designing and fabricating the movable member 2 to have a self-resonant frequency corresponding to a vibration speed higher than a desired response speed, a higher response speed can be realized for the movable member 2.

Incidentally, by contacting the movable member to the electrode with the movable member always vibrated at higher speed than a desired response speed, it is possible to realize a high response speed corresponding to a vibration frequency.

Also, by vibrating the movable member at a higher speed than a desired response speed from a predetermined position of the movable member distant from the electrode, a high response speed can be realized.

Also, by vibrating the movable member at a higher speed than a desired response speed with a state the movable member contacted on the electrode, a high response speed can be realized. In this case, the frequency for vibrating the movable member may be at a self-resonant frequency of the movable member in a form that the movable member is contacted on the electrode.

Also, by vibrating the movable member with a state the movable member contacted on the electrode, the movable member can be released from the electrode and returned, with high electrical isolation, to a predetermined position at high speed without causing a capacitance coupling between the movable member and the electrode.

2. Second Exemplary Embodiment

Figure 3:
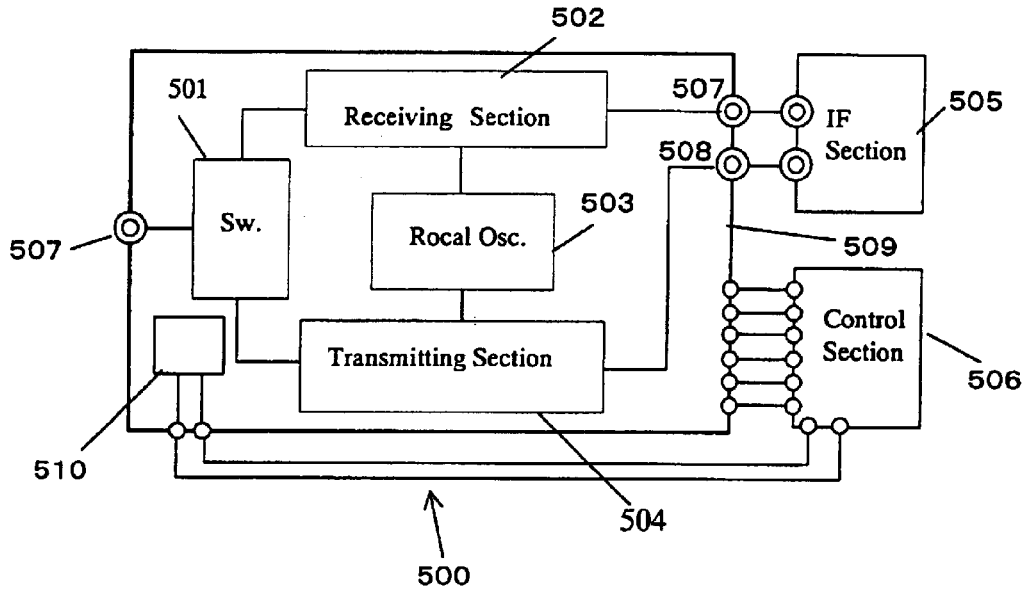
FIG. 3 is a plan view showing a schematic structure of a switch according to embodiment 2 of the invention.

FIG. 3 shows a schematic configuration diagram of a switch in embodiment 2 of the invention. A transmitting/receiving section 500 of a radio transceiver is configured with a transmission/reception switching section 501, a receiving section 502, a local oscillator 503, a transmitting section 504, a control section 506, and an IF section 505. The transmission/reception switching section 501 is switched over to a receiving end and a transmission end, depending upon a control signal from the control section 506.

In the case of signal reception, an RF signal inputted at an antenna end 507 is inputted to the receiving section 502 through the transmission/reception switching section 501 where the signal is amplified and frequency-converted and thereafter outputted, at an IF terminal 507, to the IF section 505. In the case of sending a signal, operation is reverse to the above, i.e. the signal outputted from the IF section 505 is inputted to the transmitting section 504 through the IF end 508 where it is frequency-converted and amplified, thereafter being passed through the transmission/reception switching section 501 and outputted at the antenna end 507.

Figure 4:
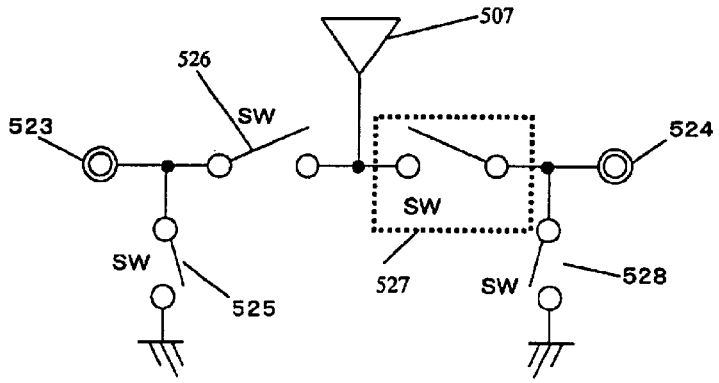
FIG. 4 is a circuit diagram showing a configuration example of a transmission/reception switching section of the switch in embodiment 2 of the invention.

The transmission/reception switching section 501, because of requiring a low-loss device, uses the switch of embodiment 1. FIG. 4 shows an configuration example of the transmission/reception switching section 501. This is configured by three terminals, i.e. a transmitting terminal 523, a receiving terminal 524 and antenna terminal 507, and four switches, i.e. switches 525–528. In the case to pass a signal to the side of the receiving terminal 524, the switches 525, 527 are put on and the switch 526, 528 are off. In the case to pass a signal to the side of the transmitting terminal 523, the switches 525, 527 are put off and the switches 526, 528 are on. With this configuration, even if the switches 525 to 528 individually are low in isolation, high isolation is available by combining the switches 525 to 528.

Figure 5A:
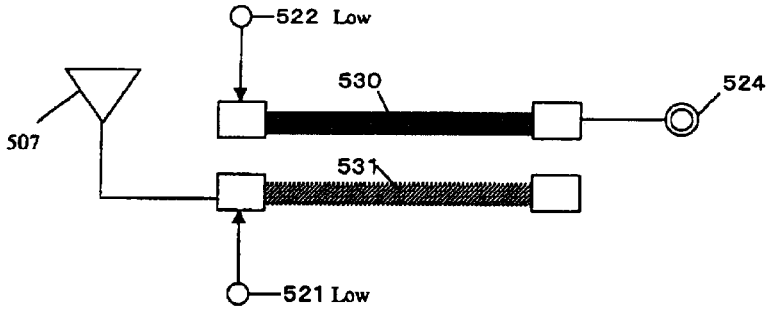
FIG. 5 is a concept view explaining a switch operation of the switch in embodiment 2 of the invention.
Figure 5B:
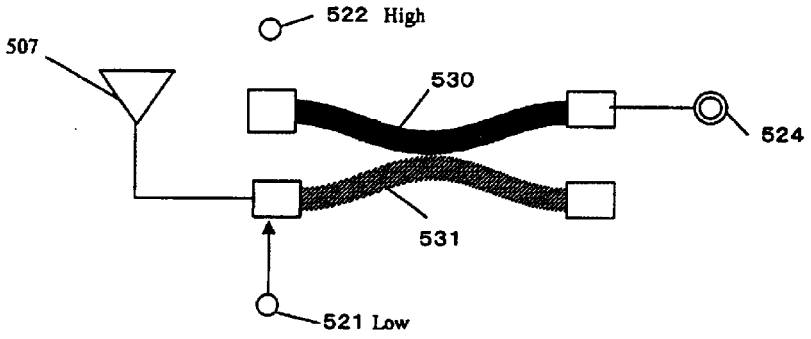

In order to prevent chattering similarly to embodiment 1, there is a need for a control signal that is not a simple control signal. Using FIG. 5, switch operation is explained on an example of the switch 507. FIG. 5A shows an off state while FIG. 5B shows an on state, respectively.

The switch 507 is structured by two movable electrodes 531, 532 fixed at both ends. In case a direct current potential is applied between the movable electrodes 531, 532, the movable electrodes 531, 532 are pulled and contacted with each other. The movable electrodes 531, 532 are arranged in such a spacing that an sufficient isolation is secured during off but driving is possible on low voltage during on. For example, in the case that each movable electrode 531, 532 has a width 2 $\mu$m, a thickness 2 $\mu$m and a length 500 $\mu$m, then the spacing between the movable electrodes 531, 532 is sufficiently 0.6 $\mu$m. Incidentally, the movable electrodes 532, 531 must not be both movable electrodes, i.e. it is satisfactory that either one is movable.

Figure 6:
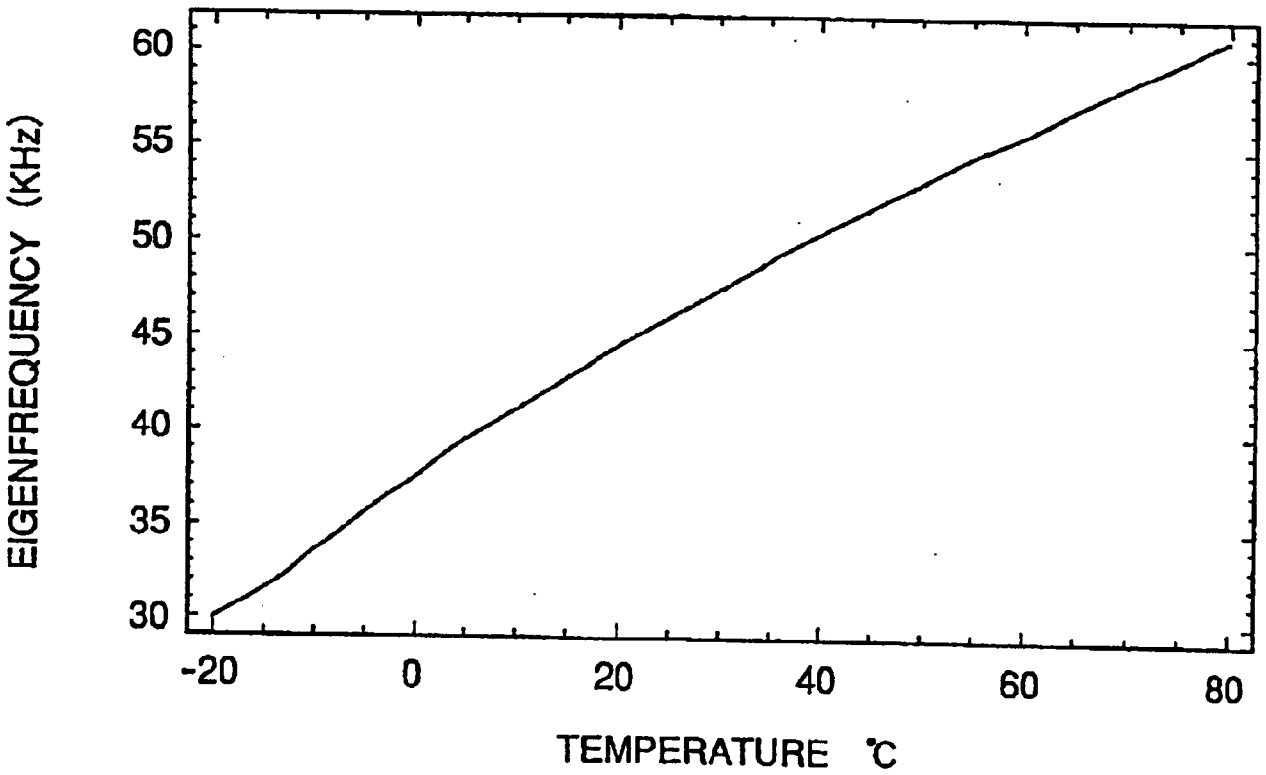
FIG. 6 is a characteristic diagram of an eigenfrequency against a temperature of a beam used in the switch in embodiment 2 of the invention.

In switching from on state to off state, the control voltage is rendered zero, to open the movable electrodes 531, 532 into off state. At this time, chattering takes place whereby the movable electrodes 531, 532 returns to the initial state while vibrating at an eigenfrequency.

Where the movable electrodes 531, 532 fixed at both ends are applied to a switch as in this embodiment, in case the materials forming the substrate and beams are different, internal stress is changed by a difference in thermal expansion coefficient. This relationship is shown in Equation 2. E represents the Young's modulus, $\Delta\alpha$ the difference in thermal expansion coefficient, and $\Delta t$ the temperature change. If assuming the beam material Al and the substrate material Si, then E=77 GPa and $\Delta\sigma=21\times10^{-6}$ t l/k results. In the case the temperature is changed from −20° C. to +80° C., internal stress changes 160 MPa and the eigenfrequency changes, as shown in FIG. 6, from 30 kHz to 60 kHz.

$$\Delta\sigma=E\ \Delta\alpha\ \Delta t \qquad \text{Eq.2}$$

It is a general practice, in the control method not using a feedback system, to compute a parameter of control signal on the basis of an eigenfrequency of the beam. In case the control signal optimized at room temperature is used at every temperature, it is impossible to obtain a sufficient chattering preventive effect, i.e. chattering may be increased in a certain case.

Figure 7:
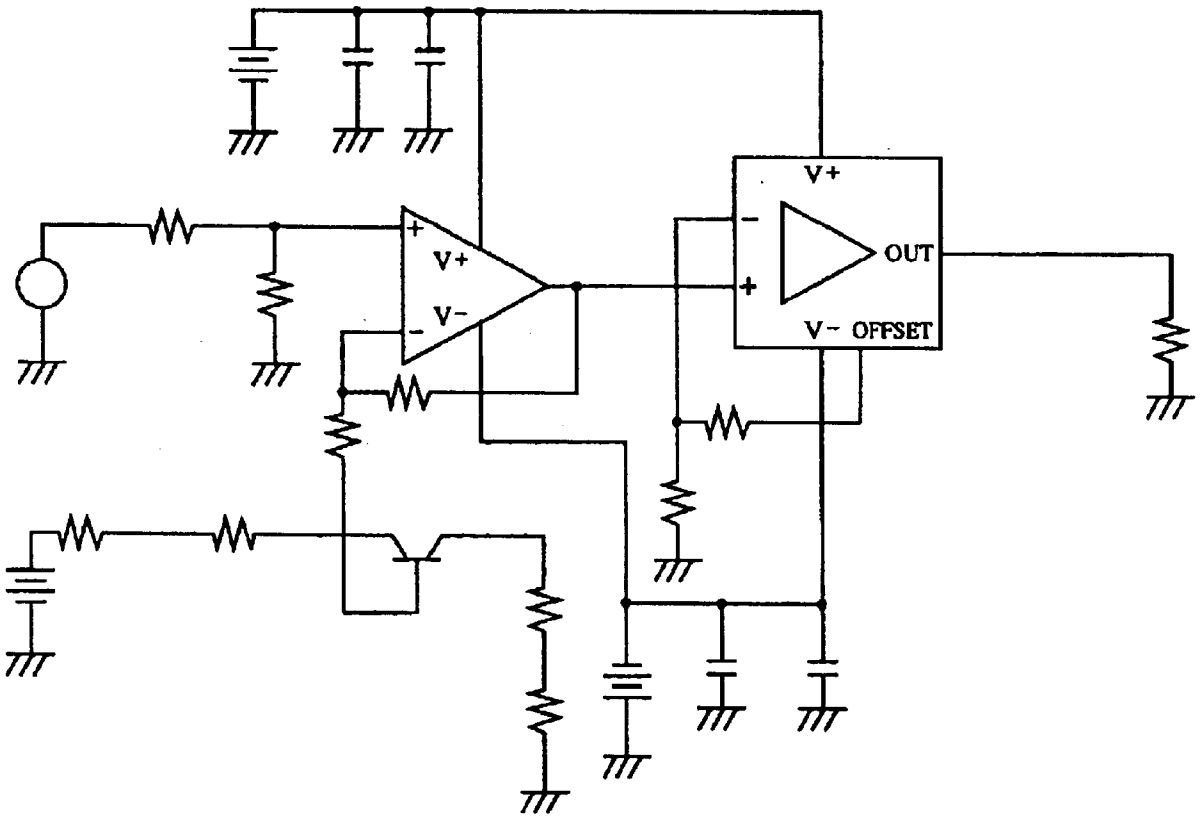
FIG. 7 is a circuit diagram showing an example of a temperature compensating circuit to be used as a temperature measuring section of the switch in embodiment 2 of the invention.
Figure 8:
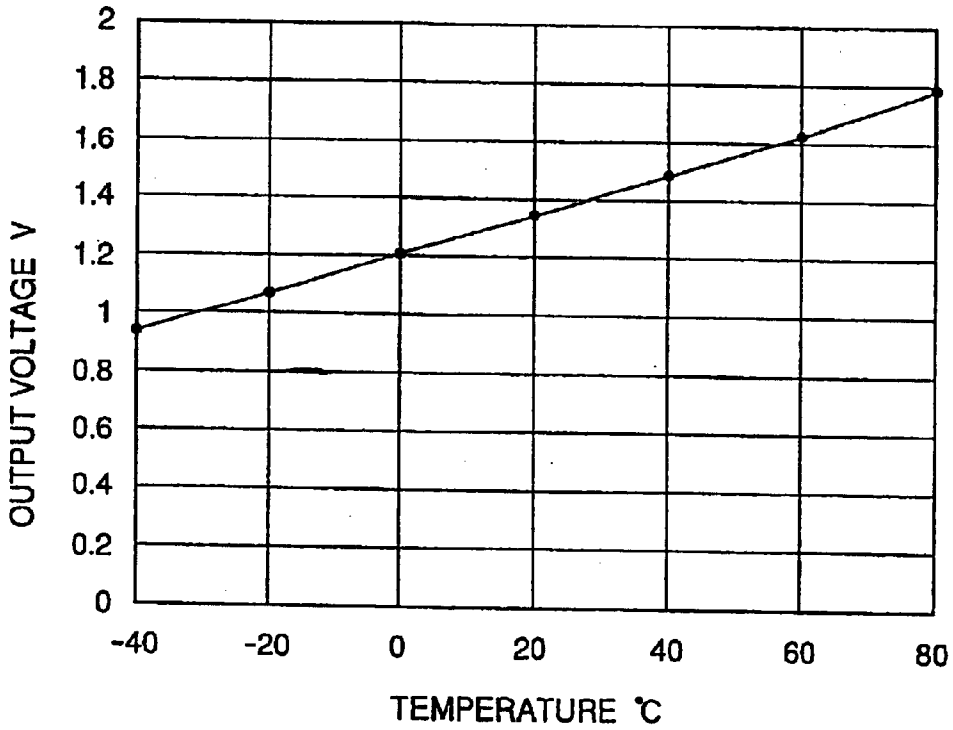
FIG. 8 is a characteristic diagram of an output of the temperature compensating circuit of FIG. 7 when temperature is changed.

Consequently, this embodiment 2 provides a temperature measuring section 510 nearby or within the transmission/reception switching section 501, in order to give an optimal control signal meeting a switch temperature. The temperature measuring section 510 can be configured by a well-known temperature compensation circuit, e.g. a simple temperature compensation circuit utilizing transistor temperature characteristics, as shown in FIG. 7. FIG. 8 shows a manner of an output voltage of upon changing the temperature from −40° C. to +80° C. in the case the temperature measuring section 510 uses a temperature compensating circuit of FIG. 7.

According to an output signal from the temperature measuring section 510, the control section 506 outputs a control signal matched to a switch temperature. In this case, it is satisfactory to previously store a table having optimal control signals based on temperature so that the control section 506 can output an optimal signal depending upon an operating temperature. Otherwise, an analog circuit may be provided to output an optimal signal.

The optimal control signal is to be computed as follows. Because the movable electrode is applied by a spring force, an electrostatic force and further a damping force, it is possible to compute a position Z of the movable member at time t from the equation of motion as shown in Equation 3. Z represents the position at time t, b the damping coefficient, k the spring constant, Fe the electrostatic force shown in Equation 4. dd shows the electrode-to-electrode distance. S the electrode area and g the electrode-to-electrode distance. Meanwhile, the initial condition of the equation of motion is taken as a speed 0 at time 0 and a position as a latch position.

$$Md^2z(t)/dt+b\{1.2-z(t)/g\}^{-3/2}dz(t)/dt+kz(t)-Fe=0 \qquad \text{Eq.3}$$

$$Fe=(1/2)(\in S/dd^2)V^2,\ \text{and}\ Zz'(0)=z(0)=-g \qquad \text{Eq.4}$$

Figure 9A:
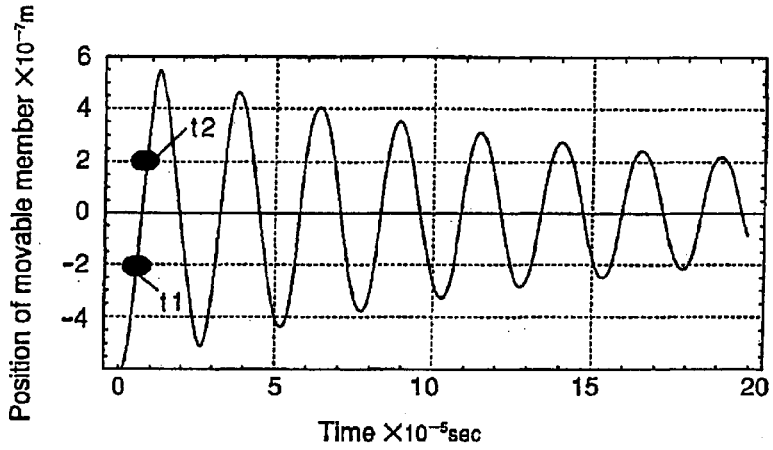
FIG. 9A is a dynamic characteristic diagram of the movable electrode at room temperature of the switch in embodiment 2 of the invention.

This equation of motion must be determined by a numerical solution instead of a general solution, because it is a nonlinear equation of motion. FIG. 9 is a dynamic characteristic computed on a movable electrode, at room temperature, in the case of a length 500 μm, a movable member width and thickness 2 μm and a gap of 0.6 μm to a fixed electrode. There is shown a manner that the latched movable electrode at time 0 is released of an electrostatic force and returned to the initial position only by the beam spring force. When the movable electrode is opened simply in this manner, the beam returns to the initial position while vibrating largely. Because of great vibration, the electrodes come near in distance to each other, to cause electrical coupling of the signal.

Consequently, the present embodiment does not simply render the control signal 0, i.e., after the control signal is rendered 0, the control signal is again applied for a certain time thereby stabilizing the dynamic characteristic of the movable electrode.

It is well known that, generally, in the case to drive the electrode on an electrostatic force, the linear control range of a movable electrode is one-third of a gap. For example, when the gap is 0.6 μm, the linear control range is 0.2 μm. For this reason, the control signal is applied at a time that the spacing between the electrodes becomes 0.2 μm. In FIG. 9, a linear control range of 0.2 μm is reached at time t1, and goes out thereof at time t2. At room temperature, it is 4.5 μm at time t1 and 8.5 μs at t2, respectively.

Next, the application voltage is computed. In case applying the potential of a spring in a manner to cancel it all by an applied electrostatic force, an application voltage can be computed from a balance of potential as shown in Equation 5. The potential of the spring is shown in the left-handed term, which is shown by a spring constant k and a displacement amount, i.e. electrode-to-electrode initial gap g. Meanwhile, the potential based on an electrostatic force is shown in the right-handed term, wherein ∈ represents the dielectric constant, V the application voltage, d the electrode-to-electrode distance, S the electrode area and x the movable range. Because electrostatic force is applied only within a linear range, if g is assumed 0.6 μm, then d is from 0.4 μm to 0.6 μm while x is 0.2 μm. In the case of the above electrode and at room temperature, the application voltage V is 10 V.

$$(1/2)kg^2(V/dd)^2Sx \qquad \text{Eq.5}$$

Figure 9B:
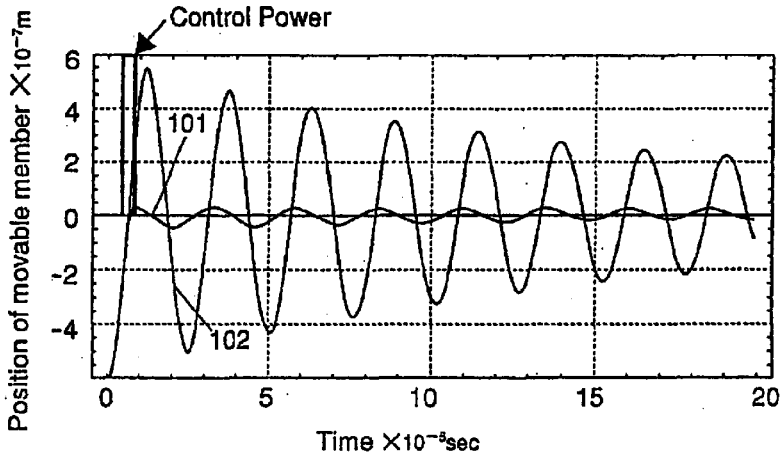
FIG. 9B is a dynamic characteristic diagram of the movable electrode of the switch in embodiment 2 of the invention, when applied by an optimal application voltage at room temperature.

FIG. 9B shows, by a curve 101, a dynamic characteristic of the movable electrode, when applied by an application voltage V in the duration of from time t1 to t2. For comparison, a curve 102 shows the case that no voltage is applied. In the case of not applying a control voltage, the movable electrode continues vibrating at an eigenfrequency until the energy is consumed out by damping, as seen in the curve 102. In the case of applying a control voltage, vibration energy is canceled by an electrostatic force as on the curve 101, allowing the movable electrode to swiftly return to the initial position.

Figure 10A:
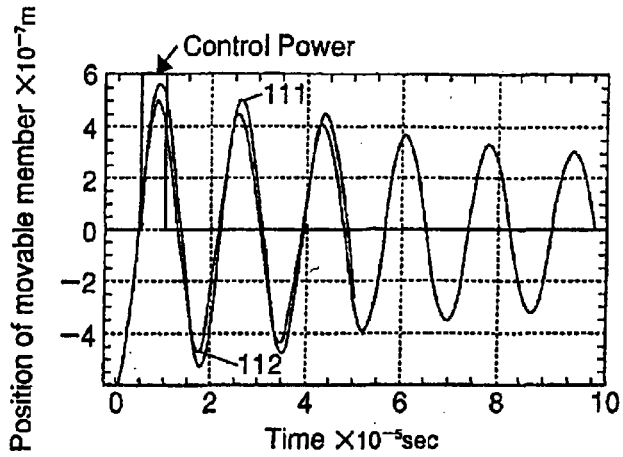
FIG. 10A is a dynamic characteristic diagram of the movable electrode at elevated temperature of the switch in embodiment 2 of the invention.

Next, explanation is made on the movable electrode dynamic characteristic in the case internal stress is changed by a temperature change. FIG. 10A shows a movable electrode dynamic characteristic that a control signal taken optimal at room temperature is applied in a state the switch temperature has changed from room temperature to 80° C. The curve 111 shows a case that a control voltage is applied while the curve 112 shows a case that a control voltage is not applied. In the case the switch temperature is changed from room temperature to 80° C., internal stress increases 80 MPa or more. Accordingly, the eigenfrequency of the movable electrode is changed. In the case that a control signal taken optimal at room temperature is applied, the movable electrode apparently overshoots as shown by the curve 111 and then a control signal is applied. Consequently, the movable electrode has a characteristic that there is almost no difference between the case that a control signal is applied as shown in the curve 111 and the case that a control signal is not applied as shown in the curve 112. In case the switch temperature is further changed and a control voltage is applied when the movable electrode is on a minus side, chattering is accelerated still more.

Figure 10B:
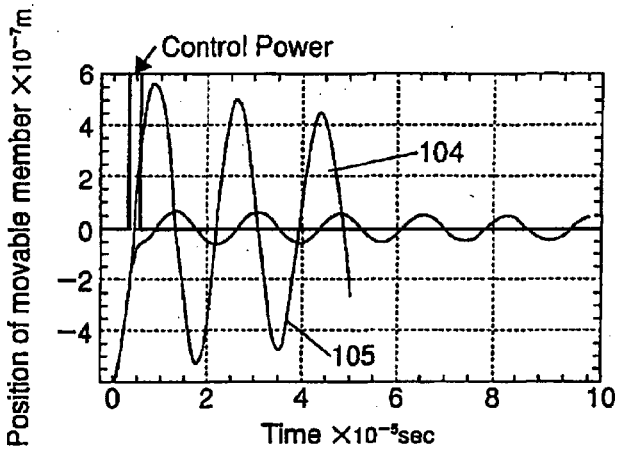
FIG. 10B is a dynamic characteristic diagram of the movable electrode of the switch in embodiment 2 of the invention, when applied by an optimal application voltage at elevated temperature.

For this reason, similarly to the case at room temperature, the optimal voltage at an elevated temperature is computed by Equation 5. This voltage is applied to the movable electrode. FIG. 10B shows the movable electrode dynamic characteristic in that case. The curve 103 is the case that a control voltage is applied while the curve 104 is the case that a control voltage is not applied. In can be seen that, in the case a control voltage is applied, as in the temperature case of FIG. 9B, vibration energy is canceled by an electrostatic force, to allow the movable electrode to swiftly return to the initial position.

Figure 10C:
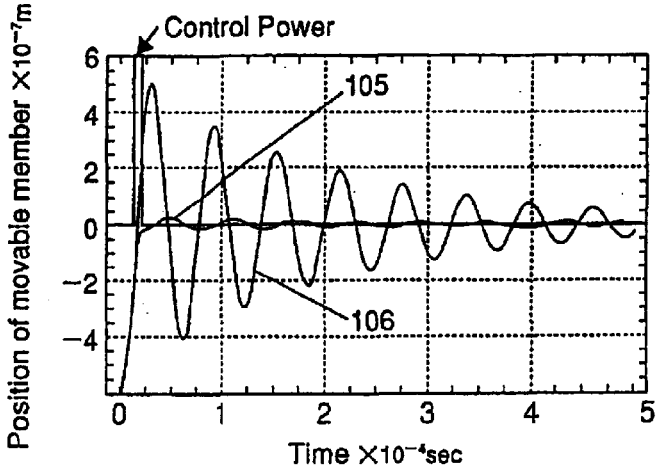
FIG. 10C is a dynamic characteristic diagram of the movable electrode of the switch in embodiment 2 of the invention, when applied by an optimal application voltage at low temperature.

In the case the switch temperature is lowered, pull-in voltage decreases because of lowered internal stress. Consequently, in case a control voltage same as that at room temperature is applied, the movable electrode, before returning to the initial position, is pulled toward the fixed electrode by the control voltage. For this reason, the optimal voltage for a lowered temperature is computed by Equation 5, which voltage is applied to the movable electrode. FIG. 10C shows the dynamic characteristic of the movable electrode at that time. The curve 105 is the case that a control voltage is applied while the curve 106 is the case that a control voltage is not applied. It can be seen that, in the case that a control voltage is applied, vibration energy is canceled by an electrostatic force, to allow the movable electrode to swiftly return to the initial position similarly to the room temperature case in FIG. 9B.

In this manner, it is emphasized to apply an optimal control signal suited for the temperature. This embodiment makes it possible to apply an optimal control voltage for a temperature change.

Incidentally, although the above explanation measured the temperature to compute a change of resonant frequency, the physical amount to be measured may be anything, besides temperature, provided that a change of resonant frequency can be computed. For example, various methods are applicable, including a method to directly read out a change in resonant frequency, a method to compute a resonant frequency from a change in pull-in voltage, a method to compute a change in internal stress from an electrode-to-electrode capacitance change, and a method to directly measure an electrode position.

3. Third Exemplary Embodiment

In using the switch, where the movable member is vibrated at all times, there is a problem that a signal is propagated to the output port with a period of a self-resonance of the movable member. As a switch this problem is solved, shown is a method that two switches are connected in series, for use as one switch.

Figure 11:
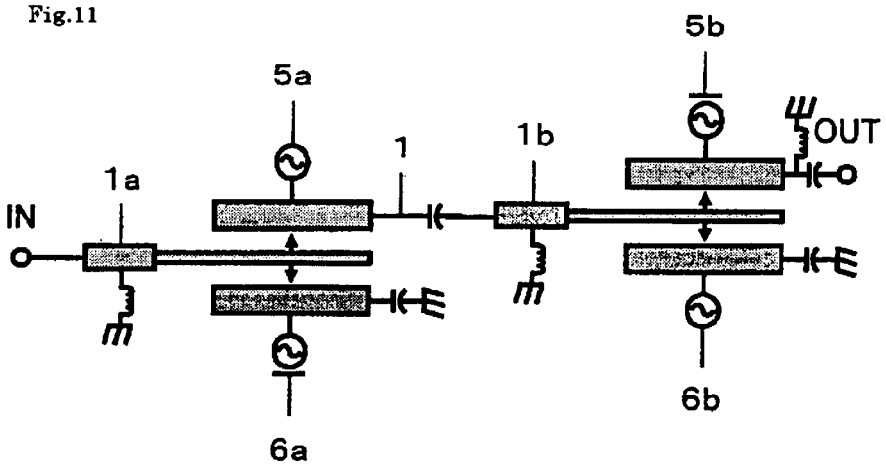
FIG. 11 is a plan view showing a schematic structure of a switch according to embodiment 3 of the invention.

FIG. 11 shows a plan view of a switch 1 in embodiment 3 of the invention. A switch 1*a* and a switch 1*b* are connected in series. The switch 1*a* has a movable member 2*a,* an on-side electrode 3*a* and an off-side electrode 4*a*. The on-side electrode 3*a* is connected with an on-side control power supply 5*a* while the off-side electrode 4*a* is connected with an off-side control power supply 6*a*. Similarly, the switch 1*b* has a movable member 2*b,* an on-side electrode 3*b* and an off-side electrode 4*b*. The on-side electrode 3*b* is connected with an on-side control power supply 5*b* while the off-side electrode 4*b* is connected with an off-side control power supply 6*b*.

In order to cut off the signal outputted at a self-resonant frequency of the movable member 2*a* from the switch 1*a,* the switch 1*b* is driven in reverse phase to the switch 1*a*. Namely, when the signal outputted at an on side of switch 1*a* reaches the switch 1*b,* the switch 1*b* is off. Consequently, the signal outputted from the switch 1*a* propagates to the ground of the off-side electrode 4*b* of the switch 4*b*. In order to drive the switches 1*a* and 1*b* reverse in phase, it is satisfactory to make the control signal reverse in phase between the on-side control power supply 5*a* and off-side control power supply 6*a* of the switch 1*a,* and the on-side control power supply 5*b* and off-side control power supply 6*b* of the switch 1*b*.

In the switch of this embodiment, when the switch 1*a* is on, the switch 1*b* must be on in order to propagate the signal. When the switch 1*a* is off, the switch 1*b* is advantageously placed in an off state in order to enhance isolation.

Incidentally, there is a problem that the control signal of the on-side control power supplies 5*a,* 5*b* go on the transmission line, and the control signal further propagates to the output port 8. However, the control signals of the on-side control power supplies 5*a,* 5*b* are reverse in phase. In case the switch 1*a* and the switch 1*b* are arranged at a sufficient near distance, the both signals offset with each other, causing no problem. Also, as shown in FIG. 11, by arranging a high-pass filter 13 in front of the output port 8, the control signal is prohibited from propagating to the output port 8 so that only the signal inputted at the input port 7 can propagate to the output port 8. For example, a control signal at 1 MHz is cut off but a signal at 800 MHZ–6 GHz is allowed to pass, or so.

Meanwhile, there is a problem that direct current flows from the on-side control power supply 5*a* to the ground for the movable member 2*b* of the switch 1*b*. However, this can be solved by connecting a capacitor 14 between the switch 1*a* and the switch 1*b,* as shown in FIG. 11.

4. Fourth Exemplary Embodiment

Figure 12:
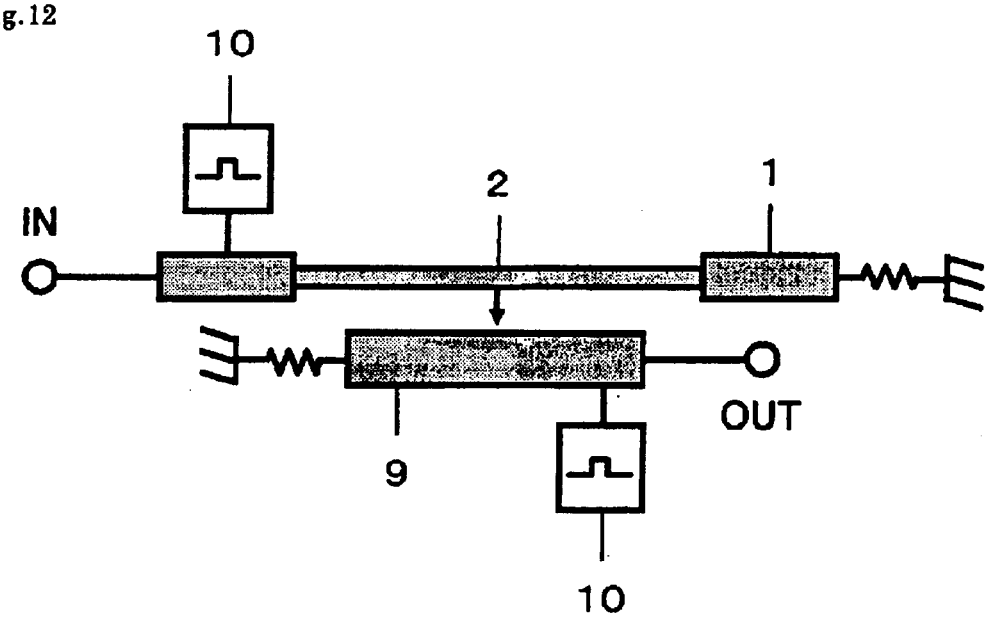
FIG. 12 is a plan view showing a schematic structure of a switch according to embodiment 4 of the invention.

FIG. 12 shows a plan view of a switch 1 in embodiment 4 of the invention. This embodiment 4 is to make a driving by the use of a Lorentz force. The movable member 2 and the electrode 9 are passed by driving currents in the same direction, to cause a non-contacting Lorentz force which is to be utilized as one driving force. Only when the movable member 2 is returned to a predetermined position distant from the electrode 9, a driving force based on the Lorentz force is provided, enabling to increase the response speed when returning to the predetermined position. The currents are under control of a control power supply 10.

The present drive scheme can be used as a hybrid drive scheme combined with another drive scheme, such as an electrostatic drive scheme, a magnetic force drive scheme, an electromagnetic drive scheme or a piezoelectric drive scheme, enabling to realize a switch higher in performance. For example, it is possible to apply a hybrid drive scheme combining the electrostatic and Lorentz force drive schemes that the movable member 2 and the electrode 9 are contacted to each other by an electrostatic force wherein, only when returning the movable member 2 to a predetermined position, a drive force based on a non-contacting Lorentz force is provided.

Incidentally, the signal propagation path can be switched over by using a drive force using an electrostatic and non-contacting Lorentz force caused by flowing drive currents through the movable member 2 and electrode 9. The two drive currents, if opposite in direction, causes an electrostatic force upon the movable member 2 and electrode 9, whereby the electrode 9 is contacted to the electrode 9. Meanwhile, in case the drive currents are in the same direction, a non-contacting force acts between the movable element 2 and electrode 9, whereby the moving member 2 is returned to the predetermined position distant from the electrode 9. The currents are under control of the control power supply 10.

Meanwhile, a high resistive material may be used in either one of the movable member 2 or the electrode 9, to utilize a polarity inversion speed due to a comparatively low carrier mobility of the high resistive material. Due to this, with the movable member 2 and the electrode 9 in contact with by an electrostatic force, the polarity of the movable member 2 or electrode 9 is inverted in which instance the movable member 2 and the electrode 9 turn into the same polarity to cause a non-contacting force. This force can be used as a drive force for returning the movable member 2 to a predetermined position.

Otherwise, a high dielectric insulation material comparatively low in polarity inversion speed may be used in an insulation layer to be formed on an electrode between the movable member 2 and the electrode 9. Due to this, with the movable member 2 and the electrode 9 in contact with by an electrostatic force, the movable member 2 is inverted in polarity in which instance the movable member 2 and the insulation layer surface turn into the same polarity to cause a non-contacting force. This non-contacting force can be used as a drive force for returning the movable member 2 to a predetermined position.

These methods enables to increase the response speed for the movable member to return to the predetermined position.

5. Fifth Exemplary Embodiment

In the mechanical switch, in the case the movable member contacted with the electrode is returned to a predetermined position distant from the electrode where isolation is high not to cause capacitance coupling between the movable member and the electrode, there is a problem of overshoot, i.e. the movable member displaces beyond a predetermined position. This is because, when the movable member is greatly overshot, capacitive coupling takes place on the electrode and movable member as signal propagation paths, forming an incorrect signal path. In order to solve such problems, embodiment 5 is to control the magnitude of an overshoot of the movable member.

Figure 13:
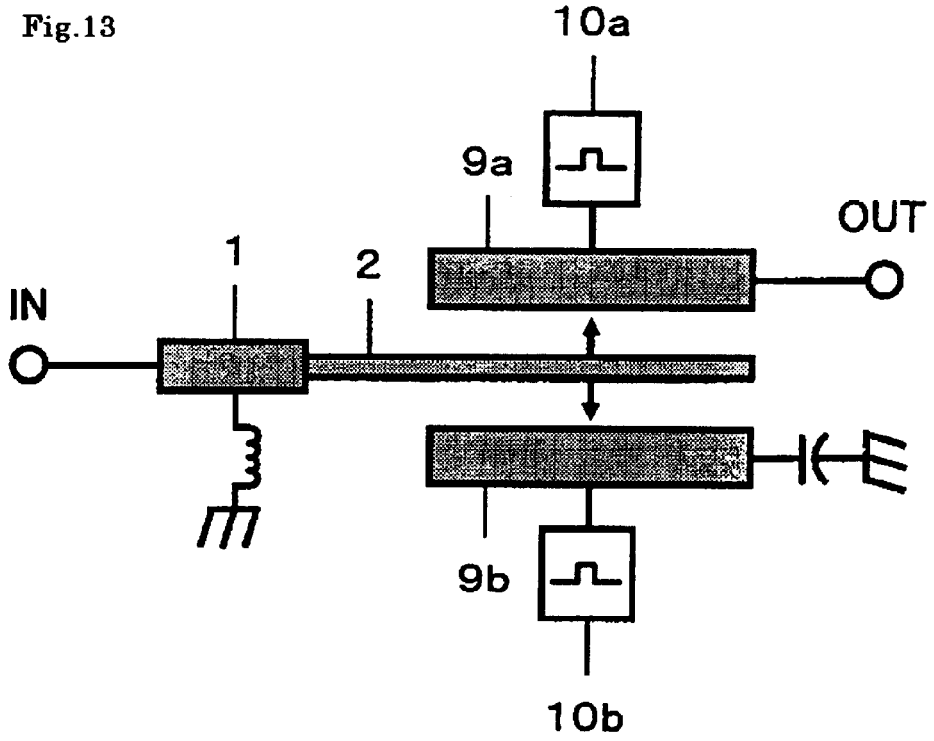
FIG. 13 is a plan view showing a schematic structure of a switch according to embodiment 5 of the invention.

FIG. 13 shows a plan view of a switch 1 in embodiment 5. By control power sources 10*a,* 10*b,* the electrostatic force acting between the movable member 2 and the electrode 9*a,* 9*b* is placed under control thereby controlling to drive the movable member 2.

Figure 14A:
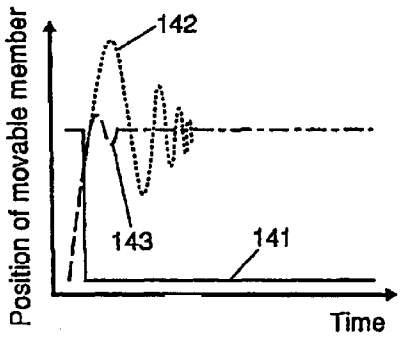
FIG. 14A is a characteristic diagram showing a control signal and movable member position in embodiment 5 of the invention.

Referring to FIG. 14, explanation is made on a method for controlling the switch 1 of embodiment 5. FIG. 14A shows a positional relationship between a control signal 141 and a position of the movable member 2. In the case that a control signal 141 is not applied, the movable member 2 vibrates as along the curve 142, to cause an overshoot. In case the control power source 10*a,* 10*b* applies a pulse-form signal shorter in time than a response time, as a control signal 141, to the movable member 2 contacted with the electrode 9*a,* 9*b,* then the movable member 2 can be returned to a predetermined position distant from the electrode 9*a,* 9*b,* as along the curve 143. Namely, the application of a force to the movable member 2 is canceled in a brief time by the control signal 141, to relieve the vibration amplitude due to overshoot of the movable member 2, thus preventing the capacitive coupling with the electrode 9*a,* 9*b*. Also, there is a merit that response speed is increased than that of before control by applying a pulse-form force to the movable member 2.

Figure 14B:
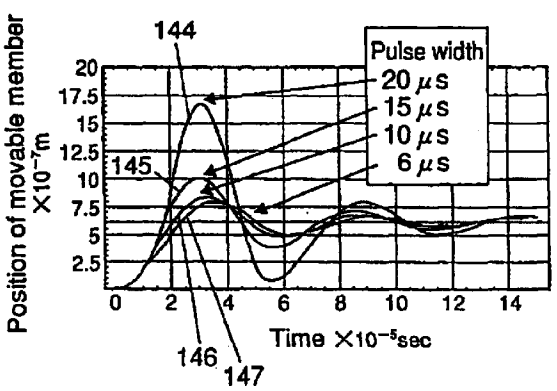
FIG. 14B is a characteristic diagram showing an overshoot in embodiment 5.

FIG. 14B shows an example of a relationship between a position and a time of the movable member 2 when changing the pulse width of the control signal 141. In FIG. 14B, the movable member 2 is in a columnar beam structure having a width of 5 μm, a thickness of 2.5 μm and a length of 500 μm, wherein shown is a case that the gap between the movable member 2 and the electrode 9*a,* 9*b* is 0.6 μm, the movable member 2 is to return to a predetermined position 0.6 μm distant from the electrode 9*a,* 9*b,* and the pulse-form control signal 141 has a voltage 7 V. In this state, in order to change the application time of a pulse-form force to the movable member 2, the pulse width of control signal 14 1 is changed as 20 μs, 15 μs, 10 μs and 6 μs. Thereupon, the movable member 2 is changed in position along the curve 144 at a pulse width 20 μs, along the curve 145 at a pulse width 15 μs, along the curve 146 at a pulse width 10 μs, and along the curve 147 at a pulse width 10 μs. As observed on the curve 144–147, it can be seen that the vibration amplitude of movable member 2 due to overshoot decreases with decrease in pulse width, simultaneously with slower response speed. The optimal condition of an overshoot magnitude and response time is under an overshoot magnitude of approximately 0.1 μm or smaller and a response time of approximately 20 μs or shorter. This is satisfied by a pulse width 10 μs, i.e. nearly a half time of a pulse width 21 μs at which pull-in is to occur.

Figure 14C:
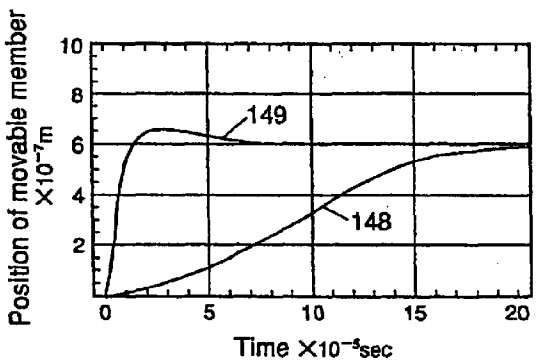
FIG. 14C is a characteristic diagram showing an overshoot before and after control in embodiment 5.

FIG. 14C shows an example of a relationship between a position and a time of the movable member 2 before and after applying a control signal 141. In FIG. 14C, the movable member is in a columnar beam structure having a width 5 μs, a thickness 0.7 μs and a length 500 μs, to have a comparatively small spring constant. Before applying a control signal, because the movable member 2 is small in spring constant, the movable member 2 has a slow response speed in returning to a predetermined position distant from the electrode 9*a,* 9*b* of the movable member 2 as along the curve 148. However, it can be seen that the movable member can be controlled in displacement such that, after the control of applying a force having an optimal pulse width 10 μs, the movable member has an increased response speed to return to a predetermined position distant from the electrode as along the curve 149 and further the overshoot is decreased in magnitude.

6. Sixth Exemplary Embodiment

Figure 15A:
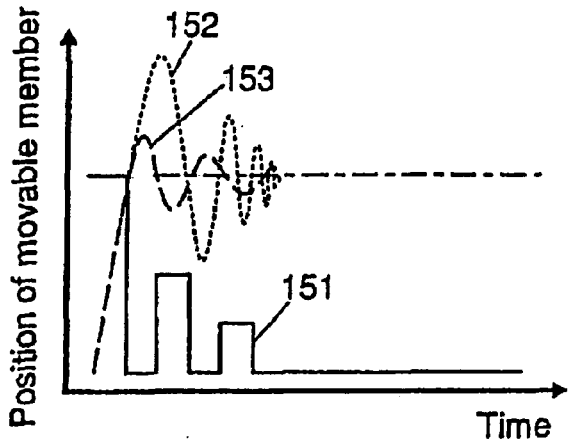
FIG. 15A is a characteristic diagram showing a control signal and movable member position in embodiment 6 of the invention.

Next explained as embodiment 6 is another method for controlling the magnitude of movable member overshoot on a switch shown in FIG. 13, with reference to FIG. 15. FIG. 15A shows a positional relationship between a control signal 151 to be supplied to one electrode 9*a* and the movable member 2.

To the movable member 2 is applied, as a control signal 151, a pulse signal opposite in direction to and corresponding in magnitude to an overshoot. As the overshoot of movable member 2 becomes greater, the greater control signal 151 is provided so that the movable member 2 can be returned through a stronger force to a predetermined position distant from the electrode 9*a*. In this case, the direction the force is applied is changed depending upon a vibration direction of movable member 2 due to overshoot. Comparing between the curves 152 and 153, the following is to be understood. Namely, it can be seen that, as compared to a position (curve 152) of the movable member prior to control where the movable member 2 is to return to a predetermined position distant from the electrode 9*a* by only a spring force of the movable member 2 without a control signal 151, the movable member after being controlled with a control signal 151 is in a position (curve 153) decreased in the vibration amplitude due to overshoot of the movable member 2.

Figure 15B:
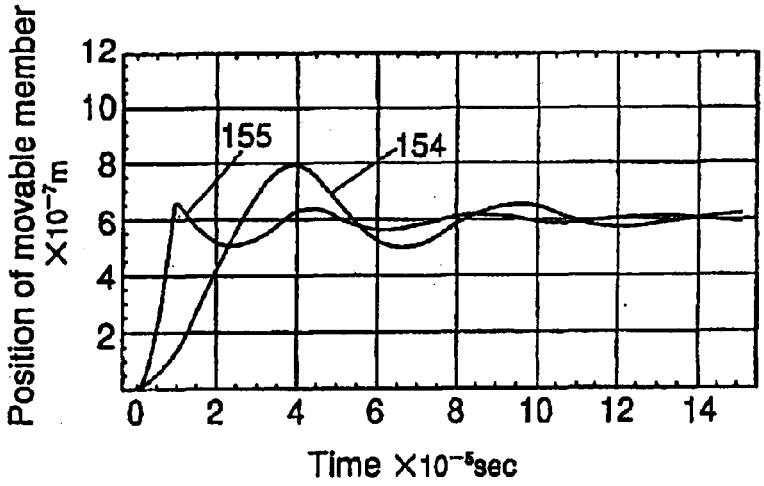
FIG. 15B is a characteristic diagram showing an overshoot before and after control in embodiment 6.

FIG. 15B shows an example of a relationship between a position and a time of the movable member 2 before and after applying a control signal 151. In FIG. 15B, the movable member 2 is in a columnar beam structure having a width 5 μm, a thickness 2.5 μm and a length 500 μm, to have a comparatively great spring constant. The gap between the movable member 2 and the electrode 9*a,* 9*b* is 0.6 μm, and the predetermined position the movable member 2 is to return is a position 0.6 μm distant from the electrode 9*a,* 9*b*.

It can be seen that, because the movable member 2 before control has a great spring constant, vibration is caused on the movable member 2 by an overshoot in returning to a predetermined position, as on the curve 154. Consequently, a control signal 151 is applied in order to always apply an asymmetric force of 10:1 to the movable member 2, alternately at the electrode 9*a* and the electrode 9*b* thereof. By doing so, the displacement of movable member 2 can be controlled to reduce the magnitude of overshoot and increase the response speed for the movable member 2 to return to a predetermined position. Meanwhile, by asymmetrically applying a force to the movable member 2 depending upon a direction of overshoot, the movable member 2 can be pulled back to a predetermined position by a strong force, reducing the magnitude of overshoot.

7. Seventh Exemplary Embodiment

Figure 16:
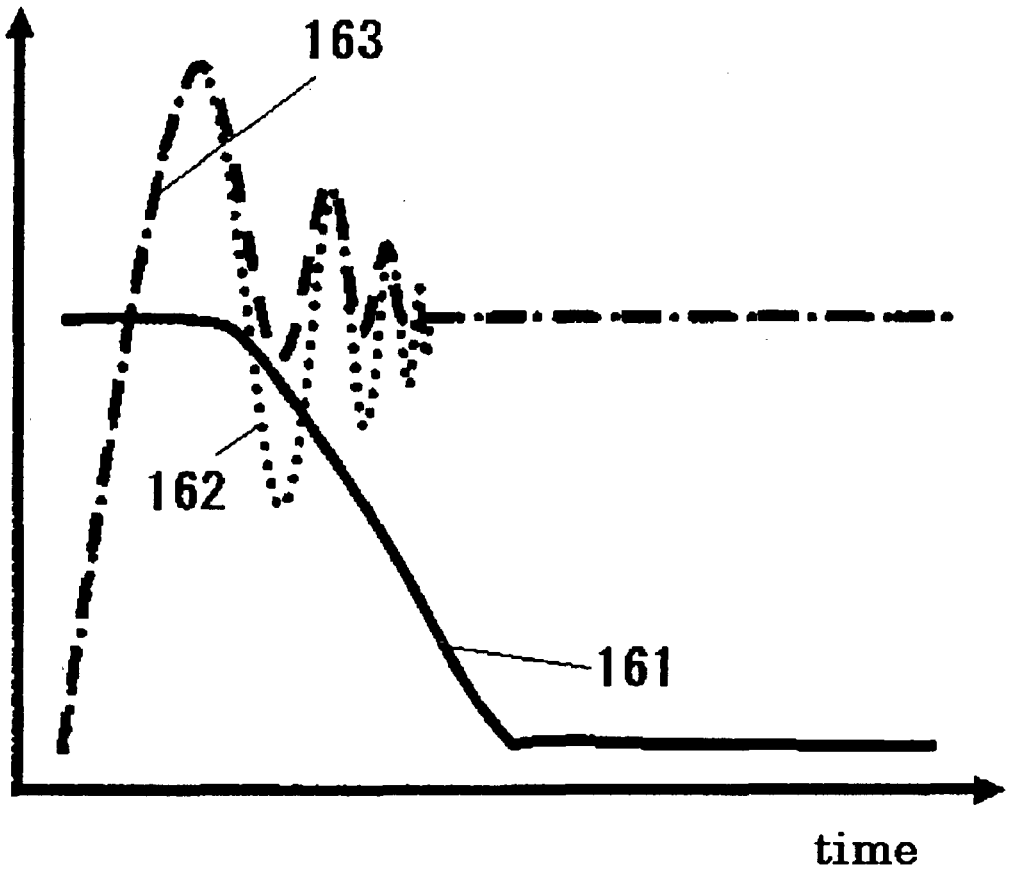
FIG. 16 is a characteristic diagram showing a control signal and movable member position of a switch in embodiment 7 of the invention.

Next explained is an embodiment on a method for controlling to relieve the magnitude of an overshoot in one direction of the movable member in a switch shown in FIG. 13. FIG. 16 shows a figure of a control signal 161 and a position of the movable member 2. In the case of not applying a control signal 161, the movable member 2 makes an overshooting as along the curve 162. Accordingly, applied is a control signal as the curve 161. Namely, control is made to apply the movable body with a force opposite in direction to the overshoot to be relieved but corresponding in magnitude to the overshoot. The control signal 161 is reduced in magnitude as the vibration of movable member 2 with overshoot is attenuated, wherein, when the movable member 2 nearly returned to a predetermined position distant from the electrode 9*a,* 9*b,* applied is the control signal 141 just like crossing the control signal 161. By doing so, the movable member 2 can relieve the magnitude of an overshoot on an opposite side to the side an electrostatic force is applied to the movable member 2.

The control signal of embodiment 5–7 makes it possible to control the magnitude of an overshoot of the movable member 2, thus preventing an incorrect signal path from being formed by a capacitance coupling between the movable member 2 and the electrode 9*a,* 9*b.* Also, the response speed can be increased for the movable member 2 to return to a predetermined position.

Incidentally, although embodiment 5–7 explained the vibration driving scheme on a movable member by an electrostatic force, the vibration driving scheme may use another driving force, such as a magnetic force.

Meanwhile, the driving scheme may be a hybrid driving scheme combining a plurality of driving schemes discretely or including other driving schemes.

Also, the switch of embodiment 5–7 can be utilized for a switch to drive a movable member in a desired direction, e.g. vertical driving type or horizontal driving type.

Also, the switch of embodiment 5–7 can be utilized for a switch of a multi-output port type, switch as SPDT or SPNT.

Also, the switch of embodiment 5–7 can be mounted on an electronic apparatus in various kinds.

8. Eighth Exemplary Embodiment

FIG. 17 is a sectional view showing one process example to manufacture a switch of the invention. As shown in FIG. 17A, a silicon oxide film 202 is formed, by thermal oxidation, in a film thickness of 300 nm on a high resistive silicon substrate 201. Thereafter, a silicon nitride film 203 is deposited in a film thickness of 200 nm by using a low-pressure CVD technique. Furthermore, a silicon oxide film 204 is deposited in a film thickness of 50 nm by using a low-pressure CVD technique.

Figure 17A:
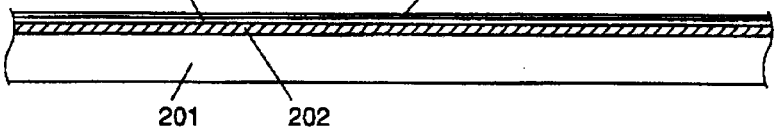
FIG. 17 is a sectional view explaining a manufacturing process of a switch in embodiment 8 of the invention.
Figure 17B:
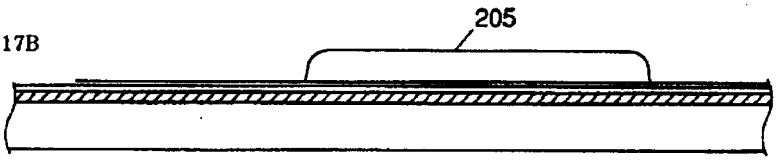

Next, as shown in FIG. 17B, a photoresist sacrificial layer is spin-coated in a film-thickness of 2 $\mu$m over the silicon oxide film 204. After exposure to light and development, baking is conducted on a hot plate at 140° C. for 10 minutes, thereby forming a sacrificial layer 205.

Figure 17C:
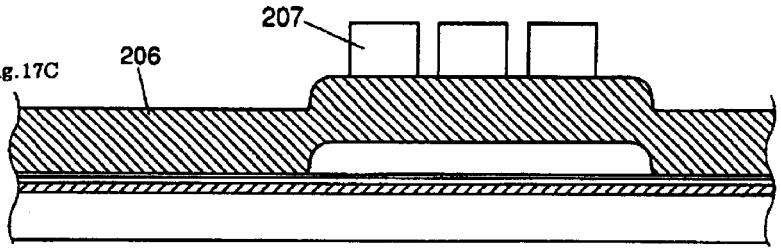

Then, as shown in FIG. 17C, Al 206 is deposited in a film thickness of 2 $\mu$m over the entire substrate surface by sputtering. Photoresist patterning 207 is made in a manner leaving the resist in a predetermined area.

Figure 17D:
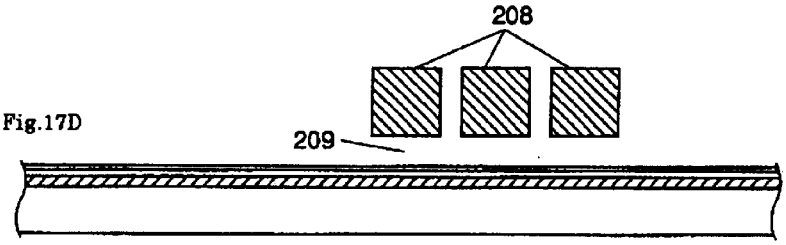

Next, as shown in FIG. 17D, the photoresist pattern 207 is used as a mask to carry out dry etching on Al 206, thereby forming an Al beam 208. Furthermore, the pattern 207 and sacrificial layer 205 are removed by oxygen plasma. As a result, formed is the beam 208 having a gap 209 to the silicon oxide film 204 on the substrate surface.

Figure 17E:
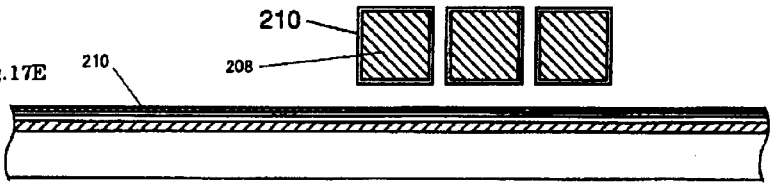
Figure 17F:
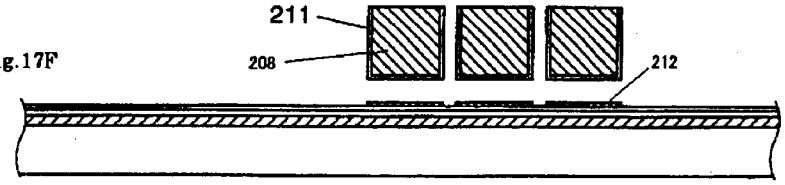

Furthermore, as shown in FIG. 17E, a silicon nitride film 210 is deposited in a film thickness of 50 nm over the entire surface of the beam 208 and silicon oxide film 204, by a plasma CVD technique. Due to this, a silicon nitride film 210 is formed on the silicon oxide film 204 on the substrate surface and around the beam 208.

Finally, as shown in FIG. 17, the silicon nitride film 210 is etched back by a dry etching process, under a condition having a selective ratio to the silicon oxide film 204 of a film thickness of equal to or greater than the deposition film thickness, e.g. 100 nm. Thus, etching is made not to leave the silicon nitride film 210 on the upper surface of the beam 208 but to leave the silicon nitride film 211 only on the side surface thereof while leaving the silicon nitride film 212 on the silicon oxide film 204 on the substrate surface only in an area corresponding to the beam 208.

Incidentally, although this embodiment used the high resistive silicon substrate 9 as a substrate 201, it may use a usual silicon substrate, a compound semiconductor substrate or an insulation material substrate.

Also, although the silicon oxide film 202, the silicon nitride film 203 and the silicon oxide film 204 were formed as insulation films on the high resistive silicon substrate 201, these insulation films may be omittedly formed where the silicon substrate has a sufficiently high resistance. Meanwhile, on the silicon substrate 201 was formed the three-layer structured insulation film having the silicon oxide film 202, silicon nitride film 203 and silicon oxide film 204. However, in case the silicon nitride film 203 has a film thickness sufficiently greater as compared to the silicon nitride film deposited on the base, i.e. a film thickness not to vanish even through so-called an etch back pressure, the silicon oxide film 204 forming process can be omitted.

Incidentally, in this embodiment, as the material forming the beam 208 Al is used. Alternatively, another metal material may be used, such as Mo, Ti, Au, Cu or the like, a semiconductor material introduced with an impurity in a high concentration, e.g. amorphous silicon, or a polymer material having conductivity. Furthermore, although sputtering was used as a film-forming method, forming may be by a CVD process, a plating process or the like.

Incidentally, in the case of contacting the movable member of a mechanical switch by an electrostatic force, the movable member and the electrode may have a contact interface in a wave form, rectangular form or the like. When forming a movable member and an electrode by a plating process, there is a need to form, through the use of a sacrificial layer 205, a gap vertically high in aspect ratio between the movable member and the electrode or an extremely narrow gap between the movable member and the electrode. By making the sacrificial layer 205 in a waveform or rectangular form, the sacrificial layer 205 is made ready to stand, enabling to form a contact interface or gap between the movable member and electrode with higher accuracy. Meanwhile, conventionally, there is a problem that, in a contact interface between the rectangular movable member and electrode, the corner of a convex part is cut into a round or the corner deep in a concave is not accurately cut leaving a sacrificial layer. However, by the structure waveformrounded in the contact interface between the movable member and the electrode, it is possible to realize an accurate contact interface/gap of movable member and electrode uniformly cut in an etching process on a sacrificial layer 205.

The switch of this embodiment has an increased contact area of the movable member and the electrode, thereby increasing the electrostatic force acting between the movable member and electrode. The switch is high in energy efficiency to generate a greater electrostatic force on the same control voltage, realizing to increase the response speed.

As described above, the present invention can realize switch high-speed response and low driving voltage, and also a relatively wide gap between the movable member and the electrode.

Also, realized is an increase in the response speed for the movable member contacted on the electrode to return to a predetermined position distant from the electrode. Furthermore, it is possible to control the magnitude of overshoot of a movable member.

Meanwhile, it is possible to realize a high-performance switch realizing signal propagation characteristic improvement, high-speed response, low consumption power and low drive power directed toward establishing a great-capacity, high-speed radio communication technology and an electronic apparatus using the same.

What is claimed is:

1. A switch for switching over a signal propagation path by contacting or non-contacting a movable member to or from an electrode, the switch comprising:

an input port for inputting a signal;

a movable member connected to the input port;

a first electrode for propagating the signal;

a first control power supply connected to the first electrode and for generating a first control signal;

a second electrode for blocking off the signal; and a second control power supply connected to the second electrode and for generating a second control signal;

the first control power supply provides said first control signal to the first electrode, the movable member being displaced by a driving force generated based on a potential difference between the movable member and first electrode and a potential difference between the movable member and the second electrode, thereby being contacted to the first or second electrode, the movable member is vibrated in a state contacted on the first electrode or the second electrode, the first or second control signal is controlled to apply to the movable member a force in one direction corresponding to a magnitude of an overshot that the movable member displaces beyond a predetermined position.

2. A switch for switching over a signal propagation path by contacting or non-contacting a movable member to or from an electrode, the switch comprising:

an input port for inputting a signal;

a movable member connected to the input port;

a first electrode for propagating the signal;

a first control power supply connected to the first electrode and for generating a first control signal;

a second electrode for blocking off the signal; and a second control power supply connected to the second electrode and for generating a second control signal;

the first control power supply provides said first control signal to the first electrode, the movable member being displaced by a driving force generated based on a potential difference between the movable member and first electrode and a potential difference between the movable member and the second electrode, thereby being contacted to the first or second electrode, the first and second control signal from the first and second control power supply, respectively, apply to the movable member a force in a pulse form in a time shorter than a response time of the movable member, the pulse-formed force has an application time that is a half in length of an application time of a pulse-formed force causing the movable member to overshoot to a position at which is to occur pull-in for the movable member to be abruptly contacted to the electrode, under an optimal condition of a magnitude of an overshoot of the movable member and the response time.

3. A switch according to claim 2, wherein the optimal condition is that the overshoot is in a magnitude of substantially 0.1 $\mu$m or smaller and the response time is substantially 20 $\mu$s or shorter.

4. A switch according to claim 1, wherein the first or second control signal is provided such that a force in a direction opposite to a direction of an overshoot and corresponding to a magnitude of the overshoot is alternately applied to the movable member at all times.

5. A switch according to claim 4, wherein the force in a direction opposite to a direction of an overshoot and corresponding a magnitude of the overshoot is asymmetric with respect to a direction.

6. A switch according to claim 1, wherein the first and second control signal from the first and second control power supply, respectively, apply to the movable member a force in a pulse form in a time shorter than a response time of the movable member.

7. A switch according to claim 1, wherein the movable member and the electrode has a contact interface in a waveform or rectangular form.

8. A switch according to claim 2, wherein the movable member and the electrode has a contact interface in a waveform or rectangular form.

9. A switch according to claim 3, wherein the movable member and the electrode has a contact interface in a waveform or rectangular form.

10. A switch according to claim 4, wherein the movable member and the electrode has a contact interface in a waveform or rectangular form.

11. A switch according to claim 5, wherein the movable member and the electrode has a contact interface in a waveform or rectangular form.

* * * * *